United States Patent [19]

Emerson et al.

[11] 4,322,451

[45] Mar. 30, 1982

[54] METHOD OF FORMING A COLLOIDAL WETTING SENSITIZER

[75] Inventors: John A. Emerson, Alexandria Township, Hunterdon County; Wesley P. Townsend, Princeton Township, Mercer County, both of N.J.

[73] Assignee: Western Electric Co., Inc., New York, N.Y.

[21] Appl. No.: 75,454

[22] Filed: Sep. 14, 1979

Related U.S. Application Data

[63] Continuation-in-part of Ser. No. 901,667, May 1, 1978, abandoned.

[51] Int. Cl.[3] ..... C23C 3/02

[52] U.S. Cl. ..... 427/53.1; 427/54.1; 427/304; 427/305; 427/306; 106/1.11

[58] Field of Search ..... 427/53.1, 34.1, 304, 427/305, 306; 106/1.11

[56] References Cited

U.S. PATENT DOCUMENTS

| | | | |
|---|---|---|---|
| 3,011,920 | 12/1961 | Shipley | 427/304 |
| 3,657,003 | 4/1972 | Kenney | 427/430.1 |
| 3,772,056 | 11/1973 | Polichette et al. | 427/304 |
| 3,772,078 | 11/1973 | Polichette et al. | 427/304 |
| 3,907,621 | 9/1975 | Polichette et al. | 427/304 |
| 3,925,578 | 12/1975 | Polichette et al. | 427/304 |
| 3,930,963 | 1/1976 | Polichette et al. | 427/304 |
| 3,976,816 | 8/1976 | Fadgen et al. | 427/304 |
| 3,993,491 | 11/1976 | Feldstein | 106/1.11 |
| 3,993,848 | 11/1976 | Feldstein | 428/457 |
| 4,020,197 | 4/1977 | Steffen | 427/304 |
| 4,048,354 | 9/1977 | Feldstein | 427/304 |
| 4,082,899 | 4/1978 | Feldstein | 428/457 |
| 4,131,699 | 12/1978 | Feldstein | 427/306 |
| 4,180,600 | 12/1979 | Feldstein | 427/304 |
| 4,181,759 | 1/1980 | Feldstein | 427/304 |
| 4,265,942 | 5/1981 | Feldstein | 427/306 |

*Primary Examiner*—Ralph S. Kendall
*Attorney, Agent, or Firm*—J. F. Spivak

[57] ABSTRACT

A method of forming a colloidal wetting sensitizer is disclosed. The method comprises combining a stannous species and a cupric species in an aqueous medium maintained at a pH of between 0.4 and 1.5.

10 Claims, No Drawings

METHOD OF FORMING A COLLOIDAL WETTING SENSITIZER

This application is a continuation-in-part of application Ser. No. 901,667, filed May 1, 1978, abandoned.

TECHNICAL FIELD

This invention relates to a method of forming a colloidal wetting sensitizer and more particularly, to forming a colloidal wetting sensitizer by combining a stannous species and a cupric species to form a tin-cuprous colloid.

BACKGROUND OF THE INVENTION

It is commonplace today to generate metallic patterns or deposits on electrically insulative or dielectric surfaces by means of electroless metal deposition techniques. Conventionally, aqueous sensitizer solutions are employed wherein a catalytic species is deposited on the surface which catalyzes electroless metal deposition from a suitable electroless metal deposition solution. Where the surface to be metallized is hydrophobic, as for example in the case of most organic polymeric substrate surfaces, it is often very difficult to achieve wetting thereof by the conventional aqueous sensitizer solutions thereby leading to electroless metal deposits which are discontinuous and/or have poor adhesion to the surface metallized.

One such prior art technique is disclosed in U.S. Pat. No. 3,993,491. Here, surfaces of dielectric substrates are catalyzed for electroless metal deposition thereon by treating the substrate with aqueous solutions containing stannous and copper ions in the form of a soluble complex and then with a chemical reducing agent capable of reducing cuprous ion to the metallic state. The compositions set forth in this patent are aqueous solutions and not wetting colloidal dispersions. These solutions are generally formed under highly acidic conditions in solutions having relatively high concentrations of stannous ion as compared to the wetting colloids of the present invention. Further, there appears to be no criticality as to the method or sequence of preparing the final solution taught by this patent.

A method of electrolessly depositing a metal on hydrophobic surfaces with a continuous and adherent metal deposit is desired and needed.

SUMMARY OF THE INVENTION

This invention relates to a method of forming a colloidal wetting sensitizer and more particularly, to forming a colloidal wetting sensitizer by combining a stannous species and a cupric species to form a tin-cuprous wetting colloid.

The method comprises adding the cupric species to the stannous species in an acidic aqueous medium maintained at a pH of between 0.4 and 1.5 to form the wetting sensitizer, the molality of stannous species in solution being between 4 to 50 molal.

DETAILED DESCRIPTION

The present invention will be discussed primarily in terms of electrolessly depositing copper metal on a dielectric surface by means of a wetting colloidal sensitizer comprising a tin-cuprous colloidal species resulting from combining a stannous salt and a cupric salt in an acidic aqueous medium. It will be readily appreciated that the inventive concept is equally applicable to electrolessly depositing other suitable metals which are catalytically reduced from their respective ions. The term "wetting" as used herein refers to a surface which will sustain a film of water when in a vertical position without beading.

A suitable substrate is selected. For the production of electrical circuit patterns, suitable substrates are those which are generally electrically non-conductive. In general all dielectric materials are suitable substrates. Dielectric materials commonly employed comprise a resinous material. If desired, the resinous material may incorporate fibrous reinforcement. For instance, paper or cardboard, glass fiber or other fibrous material may be impregnated with a phenolic, epoxy or fluorohydrocarbon (e.g., polytetrafluoroethylene) resinous material and pressed or rolled to a uniform thickness. Ceramic substrates may likewise be selected.

A surface of the substrate, e.g., a polyimide substrate, a polytetrafluoroethylene substrate, is treated with the colloidal wetting sensitizer of the subject invention, to sensitize the surface. The wetting sensitizer is prepared by selecting a stannous species or salt, e.g., a stannous halide, such as stannous chloride or bromide; stannous formate; stannous acetate; etc., and dissolving the stannous salt in an acidified aqueous medium. Preferably, the aqueous medium, e.g., water, is acidified wth an acid having an anion or negatively charged group common with that of the stannous salt, whereby the aqueous solution formed is maintained at a pH of between 0.4 and 1.5, and preferably a pH of between 0.8 and 1.0.

To the stannous salt is added a cupric salt, e.g., the halide, formate or acetate salt, preferably having an anionic or negatively charged group common to that of the stannous salt. The amount of the cupric species added to the stannous species should be enough to completely react with and reduce the cupric species to $Cu^{+1}$ ions. For example, the ratio of stannous ion to copper ion can be as low as about 0.5:1 but is preferably between 1.5:1 and 5:1.

It is critical that the aqueous medium be maintained at a pH of between 0.4 and 1.5 in order to form the colloidal wetting sensitizer comprising the cuprous species. It is also critical in forming the colloidal wetting sensitizer that the concentration of stannous species in solution be between 0.4 and 5 weight percent. It has been found, for example in chloride solutions, that if the solution is too acidic, i.e., pH less than 0.4, any colloid which may form is non-wetting and does not result in a suitable catalytic layer upon reduction. Further, if the acid concentration is significantly higher than required to yield a pH of 0.4 or more, no colloid forms and the composition remains a true solution. In addition, it has also been found with such solutions that tin species concentrations of 1–3 weight percent tin compound are preferred. It has also been determined that should the concentration range of tin species fall below about 0.4 weight percent (4 molal) the composition is too dilute to form a wetting colloid and if above 5 weight percent (50 molal) first a non-wetting colloid forms followed by a hydrous tin oxide precipitate as the concentration increases while the pH is maintained at the required 0.4–1.5 level.

Still another important aspect of obtaining the wetting colloid surprisingly and unexpectedly is the procedure of adding the cupric species to the acidified-stannous solution rather than vice versa. By way of explanation, it is hypothesized that the colloidal species, to have the wetting property required, first must form a stannic oxide core to which cuprous and stannous ions than adsorb on the surface thereof. If the stannous ion is added to the cupric ion, this apparently and surprisingly does not effectively occur as a stable wetting colloid suitable for photoreduction does not result.

It is to be noted and stressed hereat that the fact that the cuprous species forms and is stable in the colloid is a surprising result, since thermodynamic considerations indicate that the cuprous ion should not form and be stable in an acidic aqueous medium. It is also critical that the sensitizer be wetting and colloidal in nature as opposed to a true solution as we have found that non-colloidal Cu-Sn sensitizers do not effectively catalyze a hydrophobic surface where the surface is thoroughly rinsed after sensitization, nor are electroless deposits formed over non-colloidal Cu-Sn catalysts which are capable of passing the standard scotch tape test for adhesion.

It has been found that the formation of the colloidal wetting sensitizer may be enhanced by adding an excess source of the anion or negative group, e.g., chloride ($Cl^-$), acetate ($CH_3COO^-$), etc., in the form of a third salt, e.g., KCl, $KOOCCH_3$, to the combined stannous and cupric salts. After such excess anionic addition is made, the solution may be aged which adds still further to the stability of the colloidal tin-cuprous species. Typically, the resultant solution is aged at 25° C. for 2 hours.

The surface of the selected substrate is then treated with the resultant colloidal wetting sensitizer, employing any conventional technique such as spraying, spin coating, dipping, etc., whereby the surface is sensitized. The resultant sensitized surface is then treated to reduce the cuprous species of the tin-copper colloid using any of the techniques involving (1) thermal energy, (2) radiant energy or (3) chemical reduction methods such as revealed in U.S. Pat. Nos. 3,772,056; 3,772,078; 3,907,621; 3,925,578; and 3,930,963, all of which are incorporated hereinto by reference.

In one manner of proceeding, the sensitized surface is treated, either in a blanket fashion or selectively, whereby the surface is dried and heated in a non-oxidizing atmosphere until the cuprous species contained therein is reduced to a metallic copper species capable of catalyzing thereon an electroless metal deposition from an electroless metal deposition solution.

In another manner of proceeding, a surface of a substrate is sensitized with the wetting sensitizer, which may additionally comprise a radiant energy-absorbing agent, e.g., a dye, such as 2,6 or 2,7 anthraquinone disulfonic acid disodium salt, to sensitize the surface. It is to be noted that any conventional compound or dye capable of absorbing a desired wavelength of radiation can be combined with the colloidal wetting sensitizer. The surface can be entirely coated or sensitized and then blanket exposed to a source of light radiant energy, e.g., an ultraviolet radiation energy source, to form a catalytic layer or alternatively selectively exposed to the radiant energy to form a catalytic pattern. In the alternative, the surface can be selectively sensitized with the colloidal wetting sensitizer and then exposed to the radiant energy source to form the catalytic pattern.

As previously mentioned, where light radiant energy is employed to reduce the cuprous species to the catalytic metal species, the sensitizing solution preferably contains a radiant energy absorbing compound, e.g., a dye. Some of the reducing agents disclosed in the patents incorporated herein by reference are suitable absorbing compounds. Additionally, secondary reducers, e.g., lactose, sorbitol, metal reduction intensifiers, accelerators and stabilizers, all revealed in the aforementioned patents, may also be incorporated into the wetting sensitizer.

In still another manner of proceeding, a surface is sensitized with the colloidal tin-cuprous species containing sensitizer and is then chemically reduced either in a blanket fashion or selectively to form the catalytic species layer or pattern. The sensitized surface is typically dried and then treated with a chemical reducing agent, e.g., an alkali metal borohydride, such as sodium or potassium borohydride, an alkali metal hydrosulfite, e.g., sodium hydrosulfite, or an amine borane, such as dimethyl amine borane or morpholine borane, to reduce the cuprous species. Any reducing agent capable of reducing the cuprous species to the catalytic or metal species nuclei can be employed.

The treated or reduced sensitized surface is typically rinsed in running water for a short time, e.g., 30 seconds to 5 minutes, and is then immersed in a suitable electroless metal deposition solution to deposit an electroless metal deposit on the catalytic surface. Suitable electroless metal deposition solutions are well known in the art and will not be elaborated herein. Reference in this regard is made to the patents incorporated hereinto by reference, which disclose suitable electroless metal deposition solutions.

The resultant electroless metal deposit may be built up to a desired thickness by prolonged exposure to the electroless metal deposition solution or alternatively, may be further built up by being electroplated in a standard electroplating bath. Again, various electroplating solutions, plating conditions and procedures are well known in the art and will not be elaborated herein. Again, reference in this regard is made to U.S. Pat. Nos. 3,772,056; 3,772,078; 3,907,621; 3,925,578; and 3,930,963, incorporated hereinto be reference.

EXAMPLE I

A hydrophobic substrate comprising a steel core with a fully cured diglycidyl ether of bisphenol. A coating thereon was selected. The substrate comprised about 200 through holes having a diameter of about 0.50 inch. The substrate was immersed in a solvent bath comprising methyl ethyl ketone for ten minutes at 25° C. The substrate was water rinsed for one minute at 25° C. and then etched in a 1000 ml. aqueous solution comprising 360 grams $CrO_3$, 250 grams $H_3PO_4$ and 180 grams $H_2SO_4$ in water, maintained at 35° C. for ten minutes. The etched substrate was then water rinsed at 60° C. for ten minutes.

A colloidal wetting sensitizing solution was prepared by dissolving one weight percent of stannous chloride, $SnCl_2.2H_2O$, in 1 liter of water acidified with 10 ml. of 37 weight percent hydrochloric acid. To the resultant solution was added one weight percent of cupric chloride, $CuCl_2$, resulting in a dark blue solution. To the dark blue solution was added 50-gram increments of potassium chloride, KCl, until the solution became clear. Approximately 100 to 120 grams per liter of solution of KCl is employed. To the clear solution was added 0.2 to 0.5 weight percent stannous chloride and the resultant solution was aged at 25° C. for 2 hours whereby a colloidal tin-cuprous wetting sensitizer was obtained.

The etched substrate was rinsed with water for approximately 10 minutes and then immersed in the wetting sensitizer for two minutes at 25° C. The substrate was allowed to drip dry and a surface of the drip dried substrate was exposed to a high pressure mercury discharge lamp (30 watts/$cm^2$ surface at 3660A.) for five minutes. The exposed surface was water rinsed for one minute at 25° C. and then immersed in a conventional electroless metal deposition solution comprising cupric sulfate, formaldehyde, sodium cyanide, alkali and EDTA. An electroless copper deposited pattern was not obtained for some unknown reason.

EXAMPLE II

The procedure of EXAMPLE I was repeated except that to the colloidal wetting sensitizer was added a radiation-absorbing dye comprising 0.5 weight percent of a 2,7 anthraquinone disulfonic acid disodium salt. A 1.4 mils thick electroless copper deposit was obtained after 24 hours of immersion in the electroless plating solution. This deposit was continuous and was not removable with scotch tape.

EXAMPLE III 16.8 g $CUCl_2.H_2O$ was dissolved in 300 ml of water, the pH was adjusted to pH 1 with hydrochloric acid and 9.0 g $SnCl_2.2H_2O$ was added. No colloid formed.

It is to be understood that the abovedescribed embodiments are simply illustrative of the principles of the invention. Various other modifications and changes may be made by those skilled in the art which will embody the principles of the invention and fall within the spirit and scope thereof.

What is claimed is:

1. A method of depositing a metal on a hydrophobic dielectric surface, which comprises:

(a) sensitizing the surface with a colloidal tin-cuprous wetting sensitizer comprising a reaction product of a soluble stannous species and a soluble cupric species in an acidified aqueous medium maintained at a pH of from 0.4 to 1.5, prepared by adding the cupric species to the acidified stannous species and wherein the molar ratio of $Sn^{+2}/Cu^{+2}$ is from 0.5:1 to 5:1, the concentration of stannous species is 0.4–5 weight percent, the anionic portion of said species and acidifier being the same and a photosensitive material; and (b) treating said sensitized surface with radiant energy to reduce said reaction product to form a surface capable of catalyzing the deposition thereon of a metal from an electroless metal deposition solution.

2. The method as defined in claim 1 wherein said surface is selectively exposed to said source to form a surface pattern capable of catalyzing said electroless metal deposition.

3. The method as defined in claim 1 which further comprises treating said catalytic surface with an electroless metal deposition solution to deposit an electroless metal deposit thereon.

4. The method as recited in claim 1 wherein the wetting sensitizer includes a soluble compound having an anion in common with the anion of said copper and tin species.

5. The method as recited in claim 4 wherein said anion is selected from the group consisting of chloride and acetate ions.

6. The method recited in claim 4 wherein said anion is a chloride anion.

7. The method recited in claim 1 wherein the molar ratio of $Sn^{+2}/Cu^{+2}$ is from 1.5:1 to 5:1 and the concentration of stannous species is from 1 to 3 weight percent.

8. A method for depositing a metal on a hydrophobic dielectric surface comprising:

(a) sensitizing the surface with a colloidal tin-cuprous wetting sensitizer comprising a reaction product of an acidified soluble stannous species and a soluble cupric species in an aqueous medium maintained at a pH of 0.4 to 1.5 and prepared by adding the cupric species to the acidified stannous species and wherein the molar ratio of $Sn^{+2}/Cu^{+2}$ is from 0.5:1 to 5:1, the concentration of stannous species is 1 to 3 weight percent, the anionic portion of said species and acidifier being the same and including a soluble compound having an anion in common with the anion of said cupric and tin species, and a photosensitive material; and (b) treating said sensitized surface with radiant energy to reduce said reaction product to form a surface capable of catalyzing the deposition thereon of a metal from an electroless metal deposition solution.

9. The method recited in claim 8 including the step of electrolessly depositing a metal on said surface.

10. The method recited in claim 8 including the step of aging the sensitizing solution prior to treating the dielectric surface therewith.

* * * * *